US005399941A

United States Patent [19]

Grothaus et al.

[11] Patent Number: 5,399,941

[45] Date of Patent: Mar. 21, 1995

[54] OPTICAL PSEUDOSPARK SWITCH

[75] Inventors: Michael G. Grothaus, Dahlgren; Jack S. Bernardes, Fredericksburg; David C. Stoudt, King George, all of Va.

[73] Assignee: The United States of America as represented by the Secretary of the Navy, Washington, D.C.

[21] Appl. No.: 56,084

[22] Filed: May 3, 1993

[51] Int. Cl.[6] ..... H05B 37/02

[52] U.S. Cl. ..... 315/150; 315/159

[58] Field of Search ..... 315/150, 153, 154, 344, 315/155, 156, 159

[56] References Cited

U.S. PATENT DOCUMENTS

| | | | |
|---|---|---|---|
| 3,811,070 | 5/1974 | Voshall | 315/150 |
| 4,484,106 | 11/1984 | Taylor et al. | 315/150 |
| 4,490,651 | 12/1984 | Taylor et al. | 315/150 |
| 4,868,834 | 9/1989 | Fox et al. | 372/20 |
| 4,887,275 | 12/1989 | Cirkel et al. | 372/83 |
| 4,890,040 | 12/1989 | Gundersen | 315/155 |
| 4,978,893 | 12/1990 | Brannon et al. | 315/150 |
| 5,126,638 | 6/1992 | Dethlefsen | 315/326 |

*Primary Examiner*—Robert J. Pascal
*Assistant Examiner*—Darius Gambino
*Attorney, Agent, or Firm*—Jacob Shuster

[57] ABSTRACT

Disclosed is a high-voltage, high-current, multichannel, optically-triggered switch with the potential for improved lifetime of operation. Triggering of the switch is accomplished by ultraviolet illumination of multiple cathode apertures via fiber-optic cables. The trigger optics for each channel, being composed of a fiber-optic cable terminated by some collimating optics, are protected from damaging metalization by enclosing them in an angled metal or dielectric tubes in the cathode backspace. The use of collimating optics at the output of the fiber allows the fiber to be recessed inside the shield tube, providing further protection from discharge byproducts.

2 Claims, 2 Drawing Sheets

OPTICAL PSEUDOSPARK SWITCH

The invention described herein may be manufactured, used, and licensed by or for the United States Government without the payment of any royalties thereon.

BACKGROUND OF THE INVENTION

The field of this invention is pulsed power technology, and relates to high-voltage, high-current components. The disclosed device, in particular, is a high-current, low-inductance, optically-triggered, pseudospark switch.

Many devices, such as particle accelerators, fusion related devices, excimer and free electron lasers, gyrotrons, magnetrons, and electric guns require low inductance, high-repetition rates and high current, i.e., in the range of 10's to 100's of kiloamperes. It is also imperative to have components that exhibit a long operational life if these systems are to transition from the laboratory to viable operating systems.

These high-power systems generally require a switch such as a thyratron, spark gap or pseudospark switch. A pseudospark switch generally exhibits a high repetition rate and relatively low-electrode erosion, and is increasingly becoming a viable switch option when designing high-powered systems.

One such switch, taught by U.S. Pat. No. 4,890,040 issued to Gundersen on Dec. 26, 1989, discloses an optically triggered back-lighted thyratron network containing pseudospark switches which are optically triggered. All known optically triggered pseudospark switches, such as taught by Gunderson, suffer from a problem of metalization of the optical window or optical fiber which occurs as the switch fires. This metalization is exacerbated with use and is a limiting factor in incorporating optical triggering methods in pseudospark switches.

High-power switches can be the limiting component for applications such as charged particle beam accelerators, high-power microwave devices, electromagnetic launchers, and fusion-related devices. Typical performance parameters for this class of switches normally include voltage and current capability, inductance, jitter, delay, current rate-of-rise, energy dissipation, current reversal tolerance, and lifetime. The achievement of acceptable performance by a single switch design based on any particular element alone is not exceedingly difficult, but taken together, the task is quite challenging. The PseudoSpark discharge Switch (PSS), and its optically triggered counterpart, the Back-of-the-cathode Light activated Thyratron (BLT), is one particular switch designs which hold promise of achieving simultaneous improvement in the aforementioned parameters.

The BLT switch as taught by Gunderson above, has an advantage over the pseudospark switch in that it provides for optical isolation of the trigger circuitry, a major advantage in pulsed-power applications. The problem, however, is that the light necessary to initiate the discharge must pass through a window or optical fiber. This window or fiber can become metalized over time by material evaporated from the switch electrodes during current conduction. This results in a reduced switch lifetime, a major concern in repetitive pulsed-power systems.

Another disadvantage with existing high-current BLT switches is that the current is limited to a single channel resulting in electrode erosion, relatively high inductance, and a short operational life. Recent developments in pseudospark discharge switches indicate that multichannel operation holds promise of higher current capability with reduced electrode erosion and lower inductance. A discussion of multichannelling in a pseudospark switch is contained in the proceedings of the VIII IEEE Pulsed Power Conference on pages 472 through 477 in an article entitled Pseudospark Switches for High Repetition Rates and High Current Applications authored by K. Frank et al.

The current state of the art in high-power switches fails to provide an optically triggered, multichannel, low-inductance, pseudospark switch that can provide a satisfactory operational life.

SUMMARY OF THE INVENTION

Therefore, it is an object of the present invention to disclose a BLT that reduces metalization of optical components.

It is a further object of this invention to lower inductance and erosion of the switch by incorporating multiple discharge channels.

It is yet another object to teach an optically-triggered multichannel pseudospark switch.

It is a further object to teach an optically-triggered pseudospark switch that has an extended lifetime.

These and other objects are met with an optically triggered, multichannel pseudospark switch which encases the triggering optical fibers in a metal or dielectric tube and incorporates optical focusing components which allow the optical components to be recessed within the protective tube.

These and other objects, features and advantages of the invention will be evident from the following detailed description when read in conjunction with the accompanying drawings which illustrate various embodiments of the invention.

DETAILED DESCRIPTION OF THE INVENTION

Figure 1:
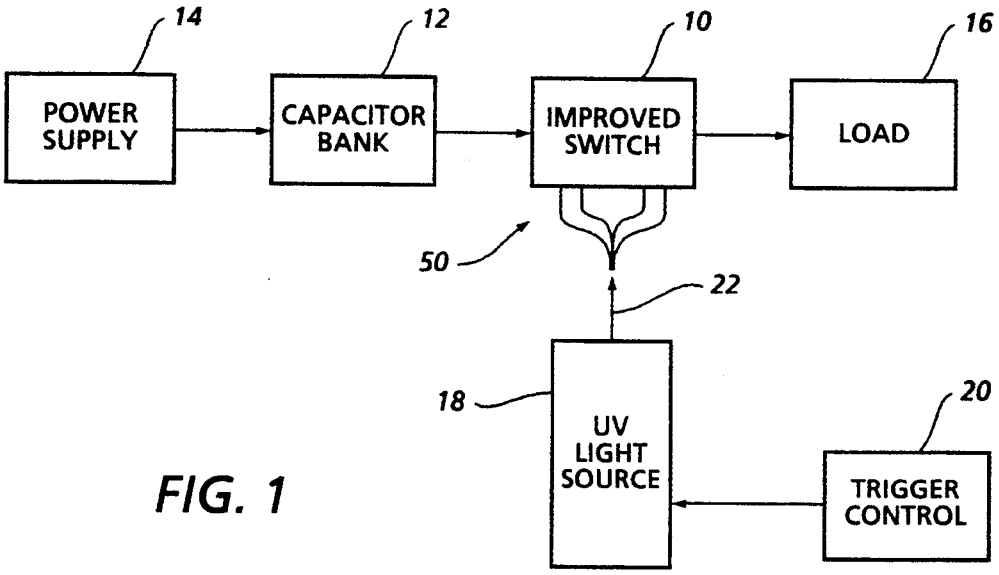
FIG. 1 is a block diagram of a simplified pulsed-power system using the improved optical pseudospark switch.

Turning now to FIG. 1, a diagram of a simplified pulsed-power system is shown with the improved optical pseudospark switch 10 of the present invention. A capacitor bank 12 of conventional design is charged slowly by a high-voltage power supply 14, also of conventional design. The improved optical pseudospark switch 10 comprising the present invention then quickly discharges the energy from capacitor bank 12 directly into the desired load 16. Load 16 might be an electric gun, particle accelerator, microwave source, high-power laser, or any other pulsed-power load requiring a high-power, high-current, high-repetition rate input. A special advantage of switch 10 is its long operational life. It is worthy of note that systems using switch 10 might also incorporate an additional power-conditioning module (not shown) as a design choice. In this contingency, the power-conditioning module would be located between switch 10 and load 16 to shape the pulse.

The improved pseudospark switch 10 is triggered by a light source 18. Light source 18 may be an ultraviolet (UV) laser or flashlamp. Ultraviolet energy is conventional in triggering back-lighted thyratrons or pseudospark switches, however, other frequency light might be employed to trigger switch 10, as a design choice, without departing from the scope of the invention. Laser or flashlamp 18 is in turn controlled by appropriate triggering circuitry 20, known to those skilled in the art of electronics. The exact circuitry of the trigger 20 will depend upon the parameters of the laser or flashlamp 18.

Light 22 from the light source 18 is directed onto a fiber-optic cable bundle 50, which then guides the illumination onto the multiple-cathode apertures of the improved optical pseudospark switch 10. As a result of this illumination, conducting channels in switch 10 will be simultaneously established and power will be delivered to the load 16. Optical isolation of the trigger circuit 20 and light source 18 from the switch, is thus obtained.

Figure 2:
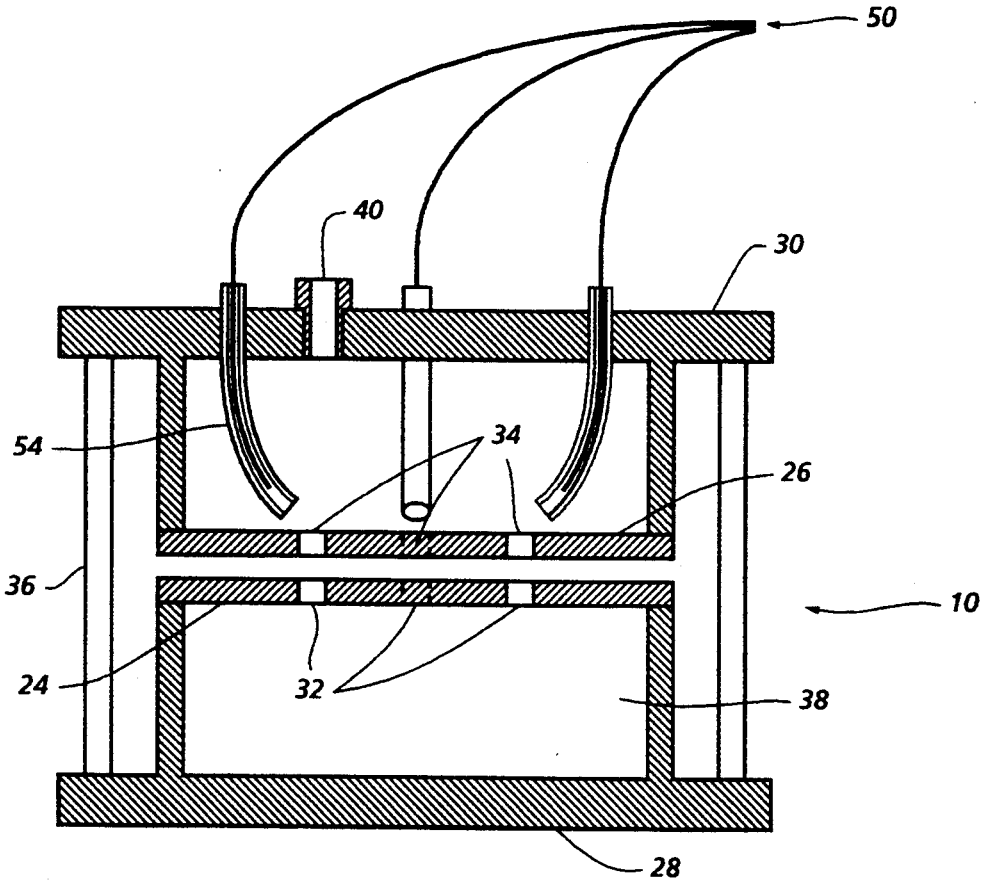
FIG. 2 is a cross-sectional view of the improved optical pseudospark switch of FIG. 1.
Figure 3:
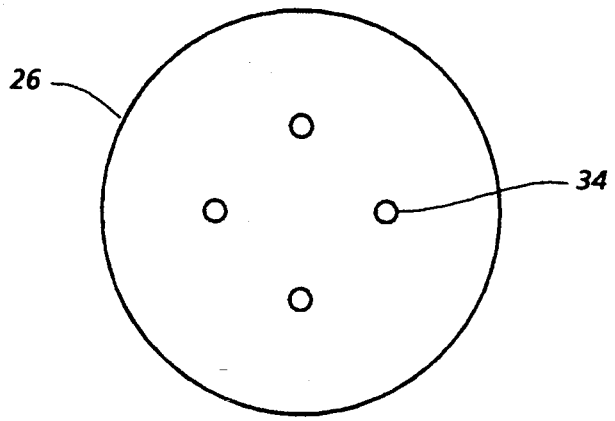
FIG. 3 is a top view of the cathode of the switch of FIG. 2.

A cross-sectional view of the improved optical pseudospark switch 10 is shown in FIG. 2. The anode 24 and cathode 26 electrode plates are configured in an inverted cup design and are separated by an appropriate distance determined by the operational voltage, usually about 3 mm. The anode electrode 24 and cathode electrode 26 are fabricated out of molybdenum or stainless steel and are brazed to the copper anode and cathode cups 28 and 30 respectively. While the electrodes are conventionally molybdenum or stainless steel, other metals might be used. Several holes 32 are drilled through the anode plate 24 and correspond with holes 34 drilled in cathode plate 26 and are arranged in the version of switch 10 illustrated in FIG. 2 about a circle centered on the switch axis. The placement geometry of the holes 34 in the switch version illustrated may be best viewed in FIG. 3. The number of holes can be varied as can their placement in anode plate 24 and cathode plate 26 as a design choice which will determine switch performance. Varying the number and placement of holes 32 and 34 will determine current handling capabilities, inductance, and to some extent, repetition rate. The number of holes will generally affect the erosion rate of the electrode plates 24 and 26 as an increase in the holes will distribute the switch discharge and distribute the heat dissipated in the electrodes, thus increasing switch life.

Each hole 32 in anode 24 is aligned with a corresponding hole 34 in cathode 26. The diameter of each anode/cathode hole pair is approximately 3 mm in the preferred embodiment illustrated, however, hole diameter may be varied to control switch hold-off voltage. Generally, the larger the diameter of the holes, the lower the hold-off voltage. However, larger holes require less light intensity for triggering. Anode and cathode cups 28 and 30 combine with a housing wall 36 to form a hermetically sealed switch volume 38. In the preferred embodiment illustrated in FIG. 2, housing wall 36 is cylindrically shaped and mates with the base of the anode and cathode cups. The geometry of the switch is a design choice and does not limit the scope of the invention. Alumina was used to form switch housing 36, but any ceramic or glass material having good insulating properties may be used. The switch housing 36 in conjunction with anode cup 28 and cathode cup 30 define a switch cavity 38 which is evacuated and maintained at a pressure of a few hundred millitorr of hydrogen or other noble gas, thus forming a pseudospark switch.

The anode and cathode plates 24 and 26 were constructed to be about 3 mm thick. The thickness of the electrodes impacts triggering range and hold-off voltage. The anode 24 and cathode 26 are spaced to form a pseudospark gap region also approximately 3 mm in width in the preferred embodiment.

The switch gas volume can be accessed through an inlet nipple 40, as illustrated in FIG. 2 or the gas could be generated by an internal reservoir incorporated within the switch volume.

An axial pseudospark discharge centered on each hole pair is initiated when ultraviolet light is trained upon each cathode aperture 34 via a fiber-optic cable bundle 50. Fiber-optic bundle 50 is comprised of individual fibers or groups of fibers 52 corresponding with each anode/cathode hole pair. Each of the fibers 52 enter the switch interior 38 via a shielding tube 54.

Figure 4:
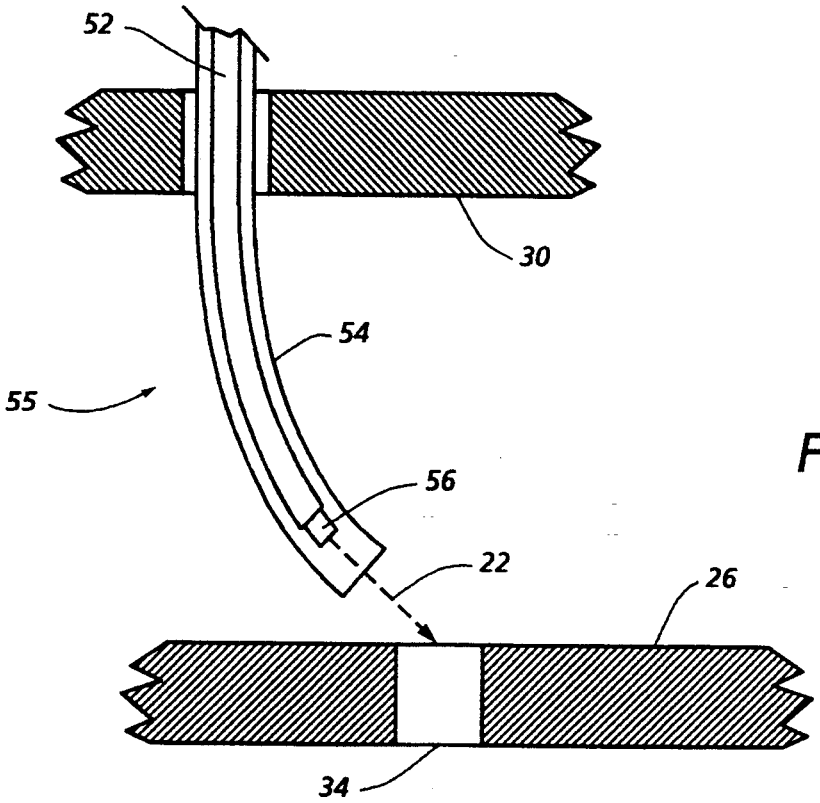
FIG. 4 is an enlarged view of the fiber-optic trigger geometry of the switch of FIG. 2.

FIG. 4 shows an enlarged view of one of the trigger tubes 55. Therein, fiber-optic cable 52 and collimating optics 56 are enclosed by a metallic or dielectric shield 54. The tubes provide structural support for fiber 52, but, more importantly, shield the fiber from metalization which has been a troublesome and a lifetime limiting problem in back-lighted thyratrons. The collimating optics 56 allows fiber 52 to be recessed within the shield tube 54 thus further reducing metalization.

In the preferred embodiment, a metallic shield 54 is in electrical contact with the cathode cup 30. It is also possible, however, to bias an electrically isolated shield 54 with respect to the cathode 30 to affect ion deposition. Furthermore, self-biasing of the shield 54 can be achieved by fabricating the shield out of a dielectric material. The dielectric shield 54 will charge up due to the impact of charged particles from the discharge. The resulting potential, like that of the externally biased metal shield, will affect ion deposition.

Figure 5:
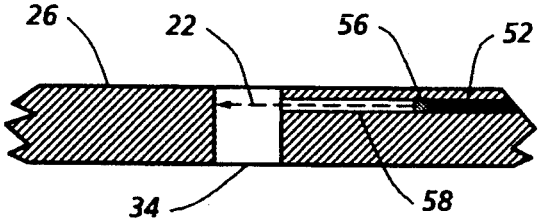
FIG. 5 is a view showing the optical fiber and collimating optics of one version of the switch of FIG. 1.

FIG. 5 shows an embodiment of switch 10 wherein cathode plate 26 has an internal channel 58. In this embodiment, the cathode plate 26 becomes the shield and the optical fiber 52 and collimating optics 56 are mounted within channel 58. In this version, the illumination 22 is more directly applied to cathode hole 34. It is believed that initiation of switch conduction is best facilitated by having the illumination directly within the cathode holes 34.

While particular embodiments of the present invention have been shown and described, it will be obvious to those skilled in the art that changes and modifications may be made without departing from the invention in its broader aspects. Therefore, the aim of the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An improved optically-triggered pseudospark switch having an opposing cathode and anode mounted within a low pressure switch housing wherein the improvement resides in multiple fiber-optic cables forming a plurality of triggers corresponding to a plurality of apertures in the cathode and anode;

a plurality of conducting tubes shielding said multiple fiber-optic cables from metallization, said multiple fiber-optic cables being physically mounted within the cathode whereby the cathode forms said plurality of conducting tubes.

2. An improved optical pseudospark switch for use in a high-power, high-current and high-repetition rate current comprising:

a cylindrical anode cup having an extended base; a cylindrical anode plate having a plurality of apertures, said cylindrical plate being affixed to said cylindrical anode cup;

a cylindrical cathode cup having an extended base opposing said cylindrical anode cup;

a cylindrical cathode plate having a plurality of apertures in correspondence with the apertures in said anode cylindrical plate constructed so that said anode cylindrical plate and said cathode cylindrical plate define a psuedospark discharge region;

an insulating cylinder having a first end attached to the extended base on said anode cup and a second end attached to the extended base on said cathode cup forming a low pressure switch cavity;

a plurality of fiber-optic trigger cables extending through a plurality of holes in said cylindrical cathode cup;

a plurality of conducting tubes forming a shield around each of said plurality of fiber-optic trigger cables electrically and sealably attached to said extended base of said cathode cup; and collimating optics mounted within said plurality of conducting tubes whereby outputs of said fiber-optic trigger cables are focussed on the apertures in said cylindrical cathode plate.

* * * * *